US008550876B2

(12) United States Patent
Demers

(10) Patent No.: US 8,550,876 B2
(45) Date of Patent: Oct. 8, 2013

(54) FORCE-CONTROLLED SURFACE FINISHING THROUGH THE USE OF A PASSIVE MAGNETIC CONSTANT-FORCE DEVICE

(75) Inventor: Brian Demers, San Jose, CA (US)

(73) Assignee: Apple Inc., Cupertino, CA (US)

( * ) Notice: Subject to any disclaimer, the term of this patent is extended or adjusted under 35 U.S.C. 154(b) by 227 days.

(21) Appl. No.: 13/241,084

(22) Filed: Sep. 22, 2011

(65) Prior Publication Data

US 2013/0040536 A1 Feb. 14, 2013

Related U.S. Application Data

(60) Provisional application No. 61/521,067, filed on Aug. 8, 2011.

(51) Int. Cl.
*B24B 1/00* (2006.01)

(52) U.S. Cl.
USPC ..... 451/28; 451/5; 451/8; 451/10; 451/11; 451/16; 451/26; 451/57; 451/58

(58) Field of Classification Search
USPC ..... 451/5, 8, 10, 11, 28, 16, 26, 57, 58
See application file for complete search history.

(56) References Cited

U.S. PATENT DOCUMENTS 4,213,245 A * 7/1980 Armstrong ..... 33/546
4,268,999 A * 5/1981 Noto et al. ..... 451/5
4,516,212 A * 5/1985 Nagashima ..... 700/173
4,524,543 A * 6/1985 Inoue ..... 451/124
4,575,970 A * 3/1986 Kozai et al. ..... 451/26
4,637,169 A * 1/1987 Sigg ..... 451/11
4,753,048 A * 6/1988 Asada et al. ..... 451/11
4,772,161 A * 9/1988 Nagao et al. ..... 409/148
5,241,792 A * 9/1993 Naka et al. ..... 451/24
5,303,510 A * 4/1994 Calkins ..... 451/36
5,367,835 A * 11/1994 Turnbull ..... 451/5
5,441,437 A * 8/1995 Hulstedt ..... 451/1
5,447,463 A * 9/1995 Schmitz ..... 451/14
5,448,146 A 9/1995 Erlbacher
5,951,377 A * 9/1999 Vaughn et al. ..... 451/49
6,077,148 A * 6/2000 Klein et al. ..... 451/11
6,083,082 A 7/2000 Saldana
6,120,356 A * 9/2000 Jaskowiak et al. ..... 451/51
6,390,888 B1 * 5/2002 Amano et al. ..... 451/24
6,960,114 B2 * 11/2005 Lee ..... 451/5
7,524,152 B2 4/2009 Honegger et al.
8,360,818 B2 * 1/2013 Crocco et al. ..... 451/8
2004/0004405 A1 1/2004 Ausderau
2004/0157529 A1 * 8/2004 Antenen ..... 451/5
2005/0101138 A1 5/2005 Guo et al.
2009/0042479 A1 * 2/2009 Kameno et al. ..... 451/5
2010/0120334 A1 * 5/2010 Crocco et al. ..... 451/5
2011/0189927 A1 * 8/2011 Lipson ..... 451/28

* cited by examiner

*Primary Examiner* — George Nguyen
(74) *Attorney, Agent, or Firm* — Womble Carlyle Sandridge & Rice LLP

(57) ABSTRACT

A constant force finishing system used to finish a surface of a workpiece includes at least a first movement device arranged to apply a first movement to a finishing tool, the first movement having a range of distance $D_1$. The finishing system also includes a constant force device (CFD) in mechanical communication with the finishing tool, the CFD arranged to apply a second movement in conjunction with the first movement to the finishing tool, the second movement having a range of $\Delta_1$, where $D_1 >> \Delta_1$.

23 Claims, 5 Drawing Sheets

FORCE-CONTROLLED SURFACE FINISHING THROUGH THE USE OF A PASSIVE MAGNETIC CONSTANT-FORCE DEVICE

This application claims priority to and the benefit under 35 U.S.C. §119(e) of U.S. Provisional Application Ser. No. 61/521,067, filed Aug. 8, 2011, entitled FORCE-CONTROLLED SURFACE FINISHING THROUGH THE USE OF A PASSIVE MAGNETIC CONSTANT-FORCE DEVICE by Brian Demers, the entire disclosure of which is hereby incorporated herein by reference.

BACKGROUND

1. Field of the Invention

The described embodiment relates to a finishing process that uses an application of constant force.

2. Description of the Related Art

Precise surface finishing of metals using operations like sanding, grinding, polishing, buffing often requires the application of a repeatable force. The use of the repeatable force ensures that material removal and resulting surface finish is consistent across a variety of geometries. For example, the use of repeatable force can be quite useful when finishing surfaces have sharp geometries, such as around corners, protruding surfaces and features, and so forth. Conventional approaches to applying a repeatable force in various finishing operation include systems designed to use compliant mechanisms in a support structure of a surface finishing machine that to helps to ensure a more uniform application of force. These compliant mechanisms include for example: foams, coil springs, and air cylinders. However, only systems that incorporate air cylinders (when configured with a proper regulator and bleed valve) are capable of providing a constant force over their travel albeit with limitations.

Thus, in view of above, methods, apparatus and materials are desirable that facilitate the application of constant force in the finishing of work pieces having a variety of shapes.

SUMMARY

Broadly speaking, the embodiments disclosed herein describe methods, apparatus and materials for finishing a workpiece having surface features using a constant force.

In particular, a constant force finishing system used to finish a surface of a workpiece includes at least a first movement device arranged to apply a first movement to a finishing tool, the first movement having a range of distance $D_1$. The finishing system also includes a constant force device (CFD) in mechanical communication with the finishing tool, the CFD arranged to apply a second movement in conjunction with the first movement to the finishing tool, the second movement having a range of $\Delta_1$, where $D_1 >> \Delta_1$. The finishing system further includes a chuck on which is mounted the workpiece during the finishing process. In the described embodiment, the chuck moves the workpiece relative to the finishing tool. During the finishing process when a surface variation of surface S of the workpiece is encountered by the finishing tool, the first movement device moves the finishing tool within the range $D_1$ relative to the workpiece when the surface variation is determined to have a size on the order of $D_1$, and the CFD moves the finishing tool at most the distance $\Delta_1$ when the surface variation is determined to have a size on the order of $\Delta_1$ resulting in the finishing tool applying a constant force to a surface S of the workpiece throughout the finishing process.

A method for finishing a workpiece by a finishing system is described. The method is carried out by performing at least the following operations: receiving a workpiece, securing the workpiece to a chuck, moving a finishing tool to the secured workpiece until contact, starting the finishing operation. When a surface variation on surface S of the workpiece is determined to be greater than $D_1$, then using a linear motor to move the finishing tool. On the other hand, when the surface variation of surface S of the workpiece is determined to be much less than D1, then using a constant force device (CFD) to move the finishing tool.

An apparatus for finishing a workpiece by a finishing system is described. The apparatus includes at least means for receiving a workpiece, means for securing the workpiece to a chuck, means for moving a finishing tool to the secured workpiece until contact, means for starting the finishing operation, means for using a linear motor to move the finishing too when a surface variation on surface S of the workpiece is determined to be greater than $D_1$, and means for using a constant force device (CFD) to move the finishing tool when the surface variation of surface S of the workpiece is determined to be much less than $D_1$.

Non-transitory computer readable medium for storing computer code executable by a processor used to control a finishing system, the computer readable medium is described. The computer readable medium includes at least computer code for receiving a workpiece, computer code for securing the workpiece to a chuck, computer code for moving a finishing tool to the secured workpiece until contact, computer code for starting the finishing operation, computer code for using a linear motor to move the finishing tool when a surface variation on surface S of the workpiece is determined to be greater than $D_1$, and computer code for using a constant force device (CFD) to move the finishing tool when the surface variation of surface S of the workpiece is determined to be much less than $D_1$.

Other aspects and advantages will become apparent from the following detailed description taken in conjunction with the accompanying drawings which illustrate, by way of example, the principles of the invention.

BRIEF DESCRIPTION OF THE DRAWINGS

The described embodiments will be readily understood by the following detailed description in conjunction with the accompanying drawings, wherein like reference numerals designate like structural elements, and in which.

DETAILED DESCRIPTION OF THE DESCRIBED EMBODIMENTS

Figure 1:
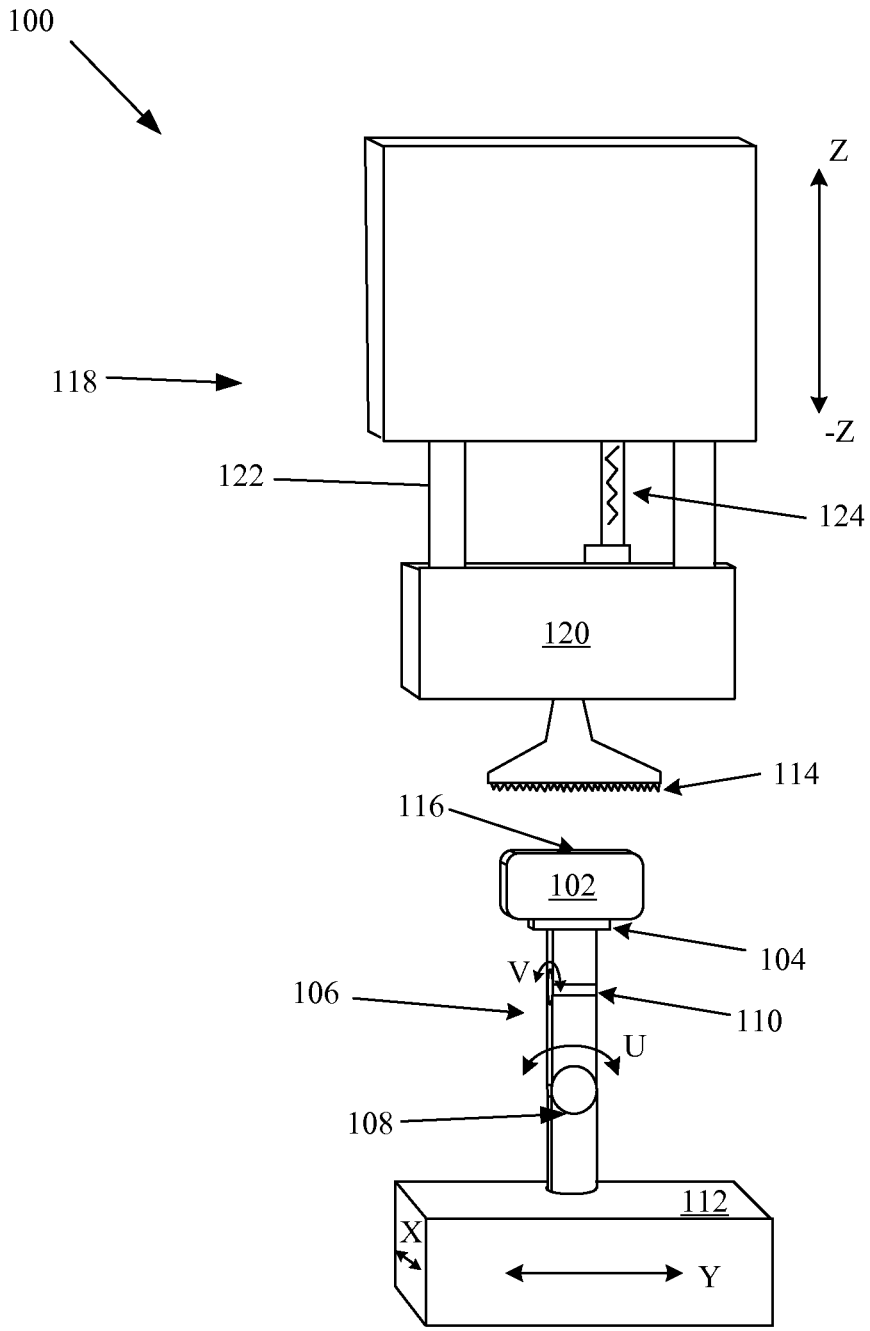
FIG. 1 is a representative finishing system in accordance with the described embodiments.

In the following detailed description, numerous specific details are set forth to provide a thorough understanding of the concepts underlying the described embodiments. It will be apparent, however, to one skilled in the art that the described embodiments can be practiced without some or all of these specific details. In other instances, well known process steps have not been described in detail in order to avoid unnecessarily obscuring the underlying concepts.

This embodiments described herein relate to the use of a constant force device (CFD) acting as a compliant mechanism arranged to apply a constant force during a finishing operation carried out by surface finishing equipment, in one embodiment, the CFD can take the form of a device having constant-force magnetic springs. Particular examples of constant force magnetic springs are magnetic springs (referred to as MagSpring® manufactured by NTI AG of Spreitenbach, Switzerland. In the described embodiments, the CFD finishing system can be used to finish a surface of a workpiece with a high degree of precision regardless of the shape of the workpiece. In one implementation, the CFD finishing system can include at least a first movement device arranged to apply a first movement to a finishing tool where the first movement has a range of distance $D_1$ and a constant force device (CFD) in mechanical communication with the finishing tool. In the described embodiment, the CFD can apply a second movement to the finishing tool in conjunction with the first movement where the second movement has a range of $\Delta_1$ where $D_1 >> \Delta_1$.

The CFD finishing system also can include a chuck on which is mounted the workpiece during the finishing process providing for the workpiece to be positioned relative to the finishing tool. During the finishing process, when the chuck places the workpiece in position, the first movement device moves the finishing tool into a contact position relative to the workpiece. In this way, the first movement device moves the finishing tool within the range $D_1$ relative to the workpiece, and the CFD moves the finishing tool at most the distance $\Delta_1$ such that the finishing tool applies a constant force to the workpiece.

Surface finishing can be applied to a work piece through the use of a device like a belt, a wheel, or an abrasive pad. Typically the workpiece can mounted on a sliding bearing, allowing it to move in one axis, towards and away from the portion of the workpiece to be finished. In one embodiment, a CFD can be configured to provide support in this axis. In this way, the motion provided by a combination of the CFD and the sliding bearing can be used together to assure that a constant force is applied to the surface of the workpiece being finished. In other words, the sliding bearing can be used to provide an overall movement of the workpiece during the finishing process whereas the CFD can be relied upon to provide the minute corrections needed to be taken into account due to the small irregularities in the surface of the workpiece being finished. For example, when the CFD is a magnetic spring, the CFD can operate in a passive manner since the spring has no electronics and no controllers. In this implementation, the CFD outputs a constant force based on its inherent specification (which is determined by its dimensions and magnetic properties). In order for this constant force to be translated properly to a part in a surface finishing operation, the orientation of the surface finishing device can be kept constant with respect to gravity. Therefore, the part being finished will be manipulated/rotated to accommodate the fixed angle of the surface finishing device.

These and other embodiments are discussed below with reference to FIGS. 1-*xx*. However, those skilled in the art will readily appreciate that the detailed description given herein with respect to these figures is for explanatory purposes only and should not be construed as limiting.

FIG. 1 is representative finishing system 100 in accordance with the described embodiments. System 100 can be used to finish surfaces of workpiece 102 mounted to chuck 104. Workpiece 102 can take many forms. For example, workpiece 102 can take the form of housing for a portable computing device and as such workpiece 102 can be formed of metal such as aluminum, high impact plastic, and so forth. Workpiece 102 can be mounted to chuck 104 using a mechanical clasp or holder. In another implementation, workpiece 102 can be mounted to chuck 104 using a vacuum form of attachment. In any case, workpiece 102 can be secured to chuck in such a way that during a finishing process, workpiece 102 can remain essentially immobile with respect to chuck 104 thereby assuring a high degree of precision.

Since workpiece 102 can take any shape, in order to assure that all aspects of surface S of workpiece 102 can be properly finished, chuck 104 can have multiple degrees of freedom for moving workpiece 102. By degrees of freedom it is meant that workpiece 102 can be translated in a pre-determined number of spatial directions and rotated about a pre-determined number of rotational axes. For example, chuck 104 can be attached to arm 106. Arm 106 can be configured to pivot and/or rotate in rotational (U,V) space. In the described embodiment, dimensional component U represents a rotational component about pivot 108 and dimensional component V represents a rotational component about hinge 110. In this way, chuck 104 can move workpiece 102 to any point within the rotational (U,V) space as required by surface S of workpiece 102 in order that constant force is applied normally to surface S. Additional degrees of freedom can be provided by mounting arm 106 directly to slider 112. Slider 112 can be configured to translate both arm 106 and chuck 104 in (X,Y) space where X represents a linear translation and Y represents a translation (orthogonal) to that of X. In this way, workpiece 102 can be moved with a number of degrees of freedom represented by (U,V,X,Y) space.

In order to finish workpiece 102, finishing material 114 (for example, sand paper), can be brought in direct contact with surface S of workpiece 102. In one embodiment, finishing material 114 can be secured to linear motion device 118. Linear motion device 118 can translate finishing material 114 in ±Z dimension relative to workpiece 102 thereby providing an additional degree of freedom. In the described embodiment, linear motion device 118 can include linear motor 120 connected to finishing material 114 by way of linear bearings 122. In the described embodiment, constant force device (CFD) 124 can be arranged in such a way that constant force $F_{const}$ is exerted by finishing material 114 on surface S of workpiece 102 during a finishing operation. In particular, when linear motor 120 is activated, finishing material 114 can be brought into direct contact with surface S of workpiece 102 by moving finishing material 114 in the −Z direction until a sensor (not shown) indicates initial contact. Once initial contact has been detected, the motion of finishing material 114 can be stopped at which point the finishing process can commence.

However, due to the nature of the direct contact between finishing material 114 and CFD 124, force applied to workpiece 102 by finishing material 114 remains essentially constant regardless of the geometry of surface S. This is particularly true in those situations where workpiece 102 has an irregularly shaped surface, protuberances, or other features that heretofore makes it difficult or impossible to apply a constant finishing force. For example, in a first motion, motor 120 can move finishing material 114 a distance $D_1$ associated with a course adjustment used to, for example, bring finishing material 114 in direct contact with workpiece 102. However, in those instances where minute variations in surface S characteristics would cause a conventional finishing process or apply a non-uniform force to surface S, the use of CFD 124 can cause finishing material 114 to move a second distance $\Delta_1$ (where $D_1 >> \Delta_1$) corresponding to any minute variations in the geometry of surface S. Such variations can be due to, for example, an irregular shape of surface S, variations in thickness of workpiece 102, and so on. CFD 124 can therefore cause finishing material 114 to apply constant finishing force $F_{const}$ to surface S of workpiece 102 regardless of any surface irregularities or surface geometries having a size scale on the order of $\Delta_1$.

Figure 2:
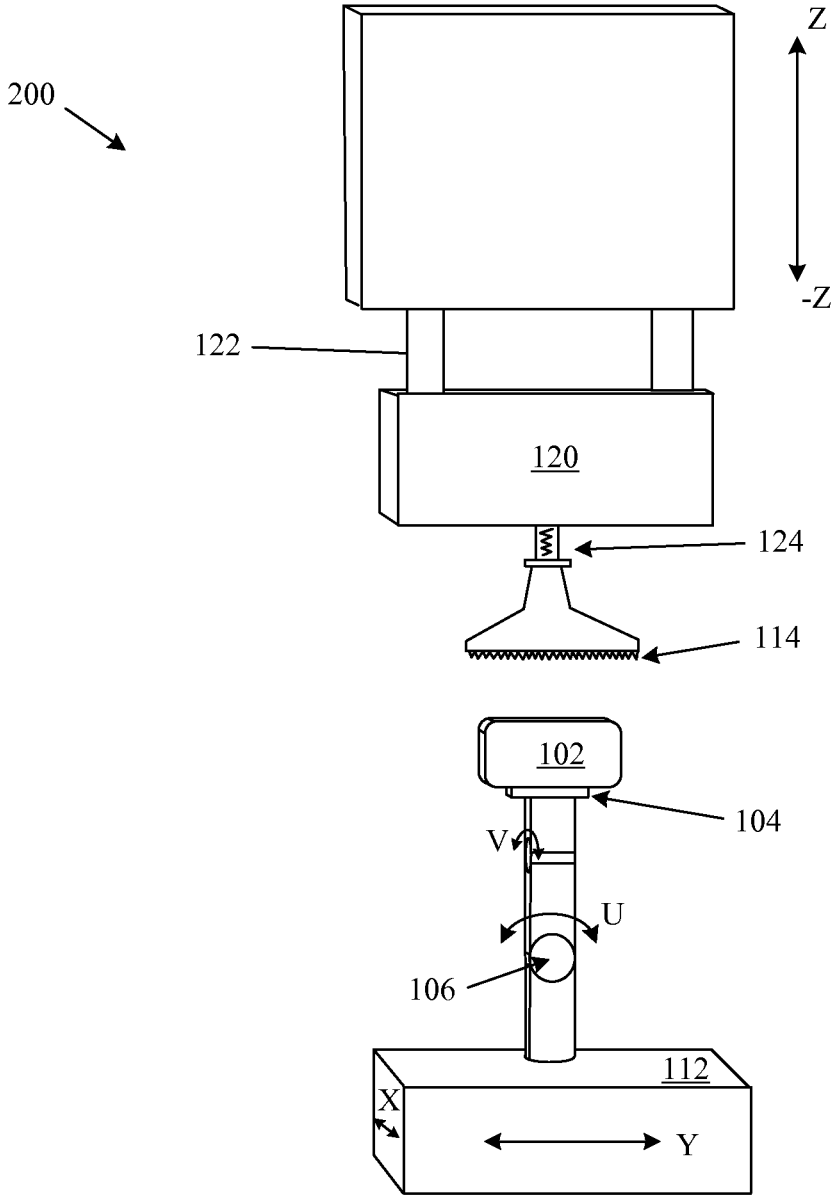
FIG. 2 is a variation of the representative finishing system shown in FIG. 1.

FIG. 2 shows another embodiment of finishing system 100 in the form of constant force finishing system 200 in accordance with the described embodiments. Constant force finishing system 200 can be arranged in such a way the constant force device (CFD) 202 can in placed in direct contact with finishing material 114. By reducing the distance between CFD 202 and finishing material 114, any delay due to the mechanical nature of motor 120 can be reduced due to the proximity of CFD 202 to finishing material 114. In this way, the amount of time between a change in surface S geometry and a resulting change in force applied by CFD 202 to finishing material 114 on surface S of workpiece 102 can be substantially reduced.

Figure 3:
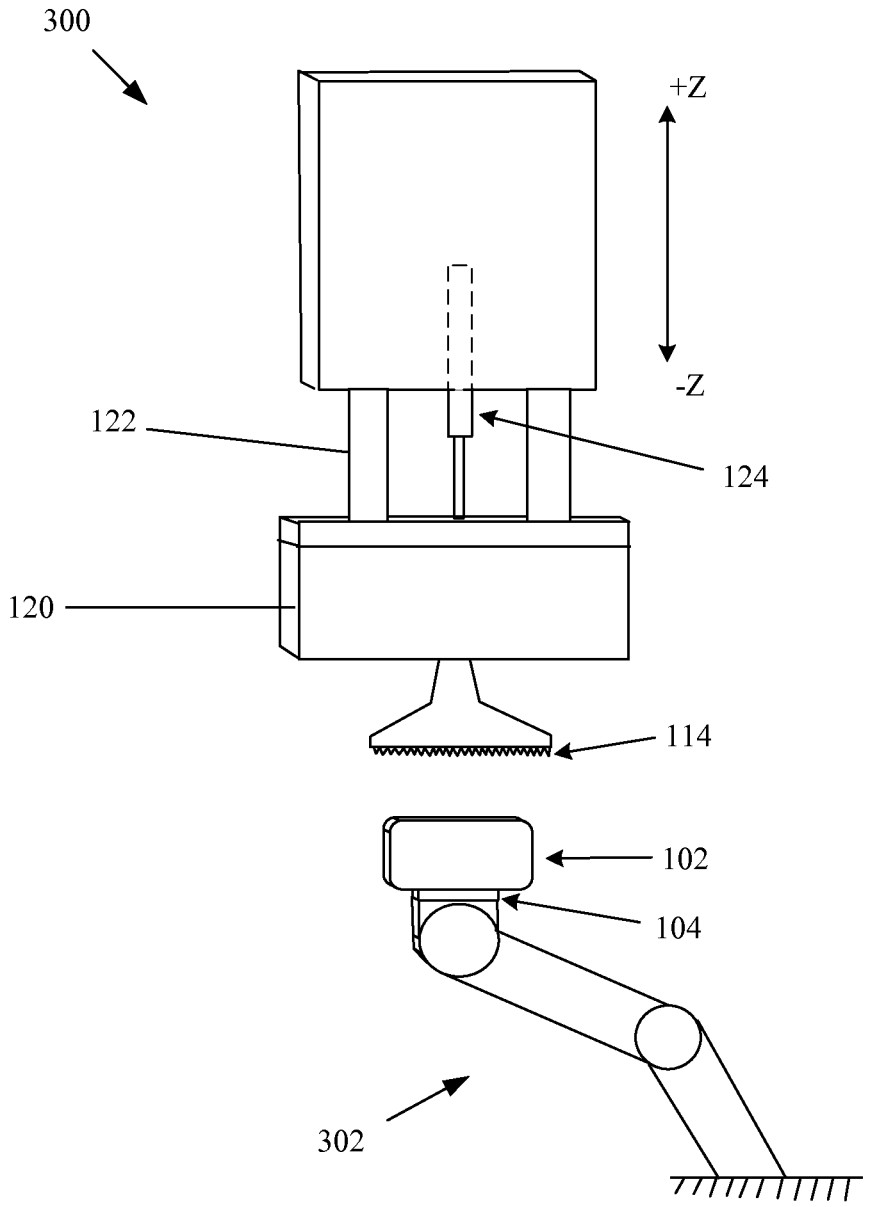
FIG. 3 and FIG. 4 shows a representative finishing system that uses a robotic arm to position and move a workpiece in accordance with an embodiment of the invention.
Figure 4:
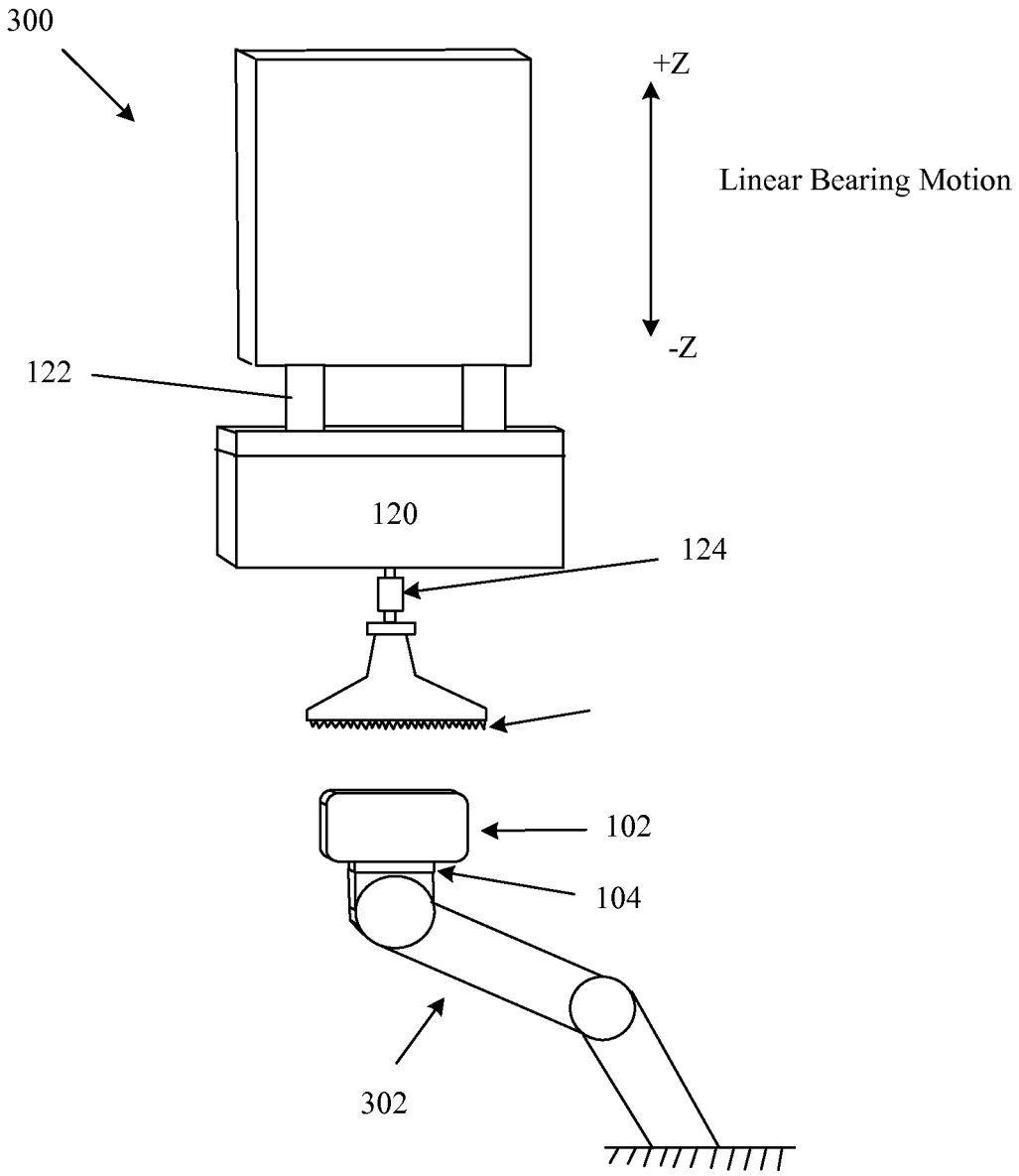

FIG. 3 and FIG. 4 show additional embodiments of finishing system 100. For example, FIG. 3 shows constant force finishing system 300 that includes robotic arm 302. In this embodiment, robotic arm 302 can be operated by a computing system programmed to move workpiece 102 by varying a speed and direction of motion of chuck 104. For example, robotic arm 302 can be controlled by a computing system that can be programmed to move robotic arm 302 in any of six degrees of freedom (DOF). In this way, a more accurate and precise movement of chuck 104 (and therefore workpiece 102) can result in a finer, more detailed finishing operation. In some embodiments, the computing system that controls robotic arm 302 can also provide control signals to linear motor 120 and/or CFD 124. In this way, the movement of finishing material 114 can be co-ordinated with that of chuck 104 and force $F_{const}$ applied by CFD 124. More particularly, finishing system 300 makes use of robotic armature 302 on which to support workpiece 304. Robotic armature 302 can have as many as six degrees of freedom (DOF).

Figure 5:
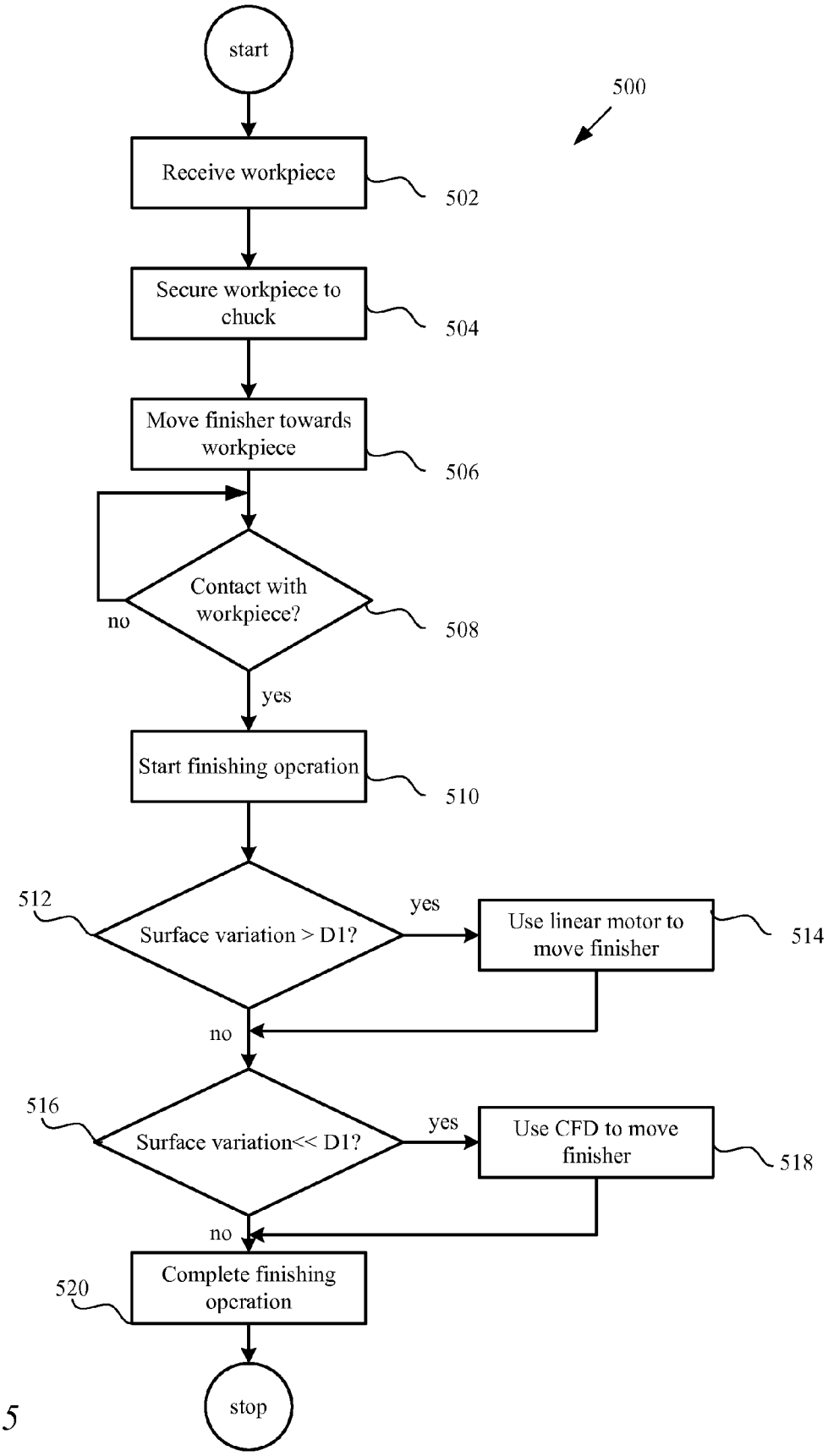
FIG. 5 is a flowchart detailing a constant force finishing process in accordance with the described embodiments.

FIG. 5 shows a flowchart detailing process 500 of finishing a workpiece using a constant force device (CFD) in accordance with the described embodiments. Process 500 can be performed by receiving a workpiece at 502 and secured to a chuck at 504. Once the workpiece is secured to the chuck, a finisher is moved towards the secured workpiece at 506. The finisher can include a finishing material that can be used to finish a surface S of the workpiece. Accordingly, the finishing material can take many forms such as abrasives along the lines of steel wool, sand paper, and so on as well as finer materials such as lamb's wool, cotton, etc. In any case, once it has been determined at 508 that contact between the finisher and surface S of the workpiece has taken place; the finishing process can begin at 510. The finishing process can involve movement of the finisher (and associated finishing material) in relation to surface S of the workpiece. Due to contours in the surface S of the workpiece (due to design protuberances, for example), a surface variation can be encountered and if at 512, the dimension of the surface variation in on the order of linear size D1, then a linear motor is used to move the finisher in relation to the encountered surface variation at 514. If, however, it is determined at 516 that the surface variation has a size on the order of $\Delta_1$ that is much smaller than D1, then a constant force device (CFD) mechanically coupled to the finisher is used to move the finisher a distance commensurate with $\Delta_1$ at 518. At 520, the finishing operation is completed when surface S is determined to be within design limitations called out in a specification associated with the finished workpiece.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A constant force finishing system used to finish a surface of a workpiece, comprising:

a finishing tool on which is mounted a finishing material used to apply a finish to a workpiece;

a first movement device coupled to the finishing tool and arranged to apply a first movement to the finishing tool, the first movement having a range of distance $D_1$;

a constant force device (CFD) in mechanical communication with the finishing tool, the CFD arranged to apply a second movement in conjunction with the first movement to the finishing tool, the second movement having a range of $\Delta_1$, where $D_1$ is much greater than $\Delta_1$; and a chuck on which is mounted the workpiece during the finishing process, wherein the chuck moves the workpiece relative to the finishing tool, wherein during the finishing process when a surface variation of surface S of the workpiece is encountered by the finishing tool, the first movement device moves the finishing tool within the range $D_1$ relative to the workpiece when the surface variation is determined to have a size on the order of $D_1$, and the CFD moves the finishing tool at most the distance $\Delta_1$ when the surface variation is determined to have a size on the order of $\Delta_1$ resulting in the finishing tool applying a constant force to a surface S of the workpiece throughout the finishing process.

2. The constant force finishing system as recited in claim 1, wherein the CFD is a constant magnetic device.

3. The constant force finishing system as recited in claim 1, further comprising:

a set of linear bearings; and a linear drive motor mechanically coupled to the finishing tool by way of the linear bearings, the linear drive motor arranged to move the finishing tool a distance on the order of $D_1$ using the linear bearings.

4. The constant force finishing system as recited in claim 3, wherein the CFD is mechanically coupled to the finishing tool by way of the linear drive motor.

5. The constant force finishing system as recited in claim 4, wherein the constant force applied by the CFD is mediated by the linear drive motor.

6. The constant force finishing system as recited in claim 3, wherein the CFD is mounted directly to the finishing tool.

7. The constant force finishing system as recited in claim 1, further comprising:

a pivoting armature, the pivoting armature arranged to rotate about a first rotation axis and pivot about a first pivot axis; and a translational block on which is mounted the pivoting armature, the translational block arranged to provide at least two translational degrees of freedom to the pivoting armature, wherein the chuck is directly mounted to the pivoting armature.

8. A method for finishing a workpiece by a finishing system, comprising:

receiving a workpiece;

securing the workpiece to a chuck;

moving a finishing tool to the secured workpiece until contact;

starting the finishing operation;

when a surface variation on surface S of the workpiece is determined to be greater than $D_1$, then use a linear motor to move the finishing tool; and when the surface variation of surface S of the workpiece is determined to be much less than D1, then use a constant force device (CFD) to move the finishing tool.

9. The method as recited in claim 8, wherein the CFD is a constant magnetic device.

10. The method as recited in claim 9, wherein the finishing system further comprises:

a set of linear bearings; and a linear drive motor mechanically coupled to the finishing tool by way of the linear bearings, the linear drive motor arranged to move the finishing tool a distance on the order of $D_1$ using the linear bearings.

11. The method as recited in claim 10, wherein the CFD is mechanically coupled to the finishing tool by way of the linear drive motor.

12. The method as recited in claim 11, wherein the constant force applied by the CFD is mediated by the linear drive motor.

13. The method as recited in claim 10, wherein the CFD is mounted directly to the finishing tool.

14. The method as recited in claim 8, the finishing system further comprising:

a pivoting armature, the pivoting armature arranged to rotate about a first rotation axis and pivot about a first pivot axis; and a translational block on which is mounted the pivoting armature, the translational block arranged to provide at least two translational degrees of freedom to the pivoting armature, wherein the chuck is directly mounted to the pivoting armature.

15. An apparatus for finishing a workpiece by a finishing system, comprising:

means for receiving a workpiece;

means for securing the workpiece to a chuck;

means for moving a finishing tool to the secured workpiece until contact;

means for starting the finishing operation;

means for using a linear motor to move the finishing too when a surface variation on surface S of the workpiece is determined to be greater than $D_1$, and means for using a constant force device (CFD) to move the finishing tool when the surface variation of surface S of the workpiece is determined to be much less than $D_1$.

16. The apparatus as recited in claim 15, wherein the CFD is a constant magnetic device.

17. The apparatus as recited in claim 16, wherein the finishing system further comprises:

a set of linear bearings; and a linear drive motor mechanically coupled to the finishing tool by way of the linear bearings, the linear drive motor arranged to move the finishing tool a distance on the order of $D_1$ using the linear bearings.

18. The apparatus as recited in claim 16, wherein the CFD is mechanically coupled to the finishing tool by way of the linear drive motor.

19. The apparatus as recited in claim 18, wherein the constant force applied by the CFD is mediated by the linear drive motor.

20. Non-transitory computer readable medium for storing computer code executable by a processor used to control a finishing system, the computer readable medium comprising:

computer code for receiving a workpiece;

computer code for securing the workpiece to a chuck;

computer code for moving a finishing tool to the secured workpiece until contact;

computer code for starting the finishing operation;

computer code for using a linear motor to move the finishing tool when a surface variation on surface S of the workpiece is determined to be greater than $D_1$; and computer code for using a constant force device (CFD) to move the finishing tool when the surface variation of surface S of the workpiece is determined to be much less than $D_1$.

21. The non-transitory computer readable medium as recited in claim 20, wherein the CFD is a constant magnetic device.

22. The non-transitory computer readable medium as recited in claim 21, wherein the finishing system further comprises:

a set of linear bearings; and a linear drive motor mechanically coupled to the finishing tool by way of the linear bearings, the linear drive motor arranged to move the finishing tool a distance on the order of $D_1$ using the linear bearings.

23. The non-transitory computer readable medium as recited in claim 22, wherein the CFD is mechanically coupled to the finishing tool by way of the linear drive motor.

* * * * *

UNITED STATES PATENT AND TRADEMARK OFFICE

CERTIFICATE OF CORRECTION

PATENT NO. : 8,550,876 B2
APPLICATION NO. : 13/241084
DATED : October 8, 2013
INVENTOR(S) : Brian Demers It is certified that error appears in the above-identified patent and that said Letters Patent is hereby corrected as shown below:

In the Claims:

Column 6, line 43: “during the” should read --during a--.

Column 7, line 22: “the finishing” should read --a finishing--.

Column 7, line 41: “the constant” should read --a constant--.

Column 8, line 4: “the finishing” should read --a finishing--.

Column 8, lines 24-25: “the constant” should read --a constant--.

Column 8, line 34: “the finishing” should read --a finishing--.

Signed and Sealed this
Thirtieth Day of December, 2014

Michelle K. Lee

Michelle K. Lee
*Deputy Director of the United States Patent and Trademark Office*